United States Patent [19]

Darrow

[11] 4,180,443

[45] Dec. 25, 1979

[54] METHOD FOR COLORING ALUMINUM

[75] Inventor: George R. Darrow, Richmond, Va.

[73] Assignee: Reynolds Metals Company, Richmond, Va.

[21] Appl. No.: 972,928

[22] Filed: Dec. 26, 1978

Related U.S. Application Data

[63] Continuation-in-part of Ser. No. 920,057, Jun. 28, 1978, abandoned.

[51] Int. Cl.[2] ..... C25D 11/22

[52] U.S. Cl. ..... 204/35 N; 204/38 A

[58] Field of Search ..... 204/35 N, 38 A, 58

[56] References Cited

U.S. PATENT DOCUMENTS

| | | | |
|---|---|---|---|
| 3,382,160 | 5/1968 | Asada | 204/35 N |
| 3,524,799 | 8/1970 | Dale | 204/58 |
| 3,669,856 | 6/1972 | Gedde | 204/58 |
| 3,704,210 | 11/1972 | Patrie | 204/35 N |
| 3,769,180 | 10/1973 | Gedde | 204/35 N |
| 3,849,263 | 11/1974 | Gedde | 204/35 N |
| 4,014,758 | 3/1977 | Kawai | 204/28 |

*Primary Examiner*—John H. Mack
*Assistant Examiner*—William Leader
*Attorney, Agent, or Firm*—Glenn, Lyne, Girard, Clark & McDonald

[57] ABSTRACT

A novel process is disclosed for the production of colored coatings on articles of aluminum or aluminum alloys which are particularly adapted to be employed for architectural uses which involves first forming a hard, dense anodic coating on aluminum and aluminum base alloys by anodizing the aluminum in a specific electrolyte comprising sulfuric acid, a polyhydric alcohol of 3 to 6 carbon atoms and an organic carboxylic acid containing at least one reactive group in the alpha position in order to obtain a material having a film thickness of between about 0.6 to about 1.1 mils and thereafter electrolytically coloring said anodized aluminum by passing alternating current between said anodized aluminum and a counter-electrode in an aqueous bath containing acid and a metal salt.

13 Claims, No Drawings

METHOD FOR COLORING ALUMINUM

RELATED APPLICATION

This application is a continuation-in-part of U.S. Pat. application Ser. No. 920,057 filed June 28, 1978, now abandoned.

BACKGROUND OF THE INVENTION

1. Field of the Invention

The present invention relates to a process for the production of colored protective coatings on articles of aluminum or aluminum alloys which have been previously anodized in a very special way in order to obtain products which are particularly suitable to be used in architectural applications.

2. Description of the Prior Art

There has been much time and attention devoted in the prior art to the production of aluminum articles in order to make them decorative or resistant to abrasion under atmospheric influence. Early processes have included coloring of aluminum articles which had previously been anodically anodized by the treatment of the same with dyes, such as aniline dyes. As the art is well aware, the thus resulting artilces have poor resistance towards atmospheric influence. Other developments have included anodic oxidation of aluminum articles, followed by submersion in chemicals which penetrate into the pores of the oxide layer, so that when the thus treated aluminum article is placed in aqueous solutions of salts which also penetrate into the pores, combination with the first used chemical is possible. These processes have not proven practical for a wide variety of reasons.

It is also known in the prior art to simultaneously anodize and color aluminum articles. However, the art is aware that processes of this type result in only a limited selection of colors and that the processes are expensive and difficult to carry out and very rigid requirements are made for the working and heat treatment of the aluminum articles as the metallic structure therein is of the utmost importance for the result obtained. These simultaneous processes also demand the use of large currents and high voltages and consequent heavy refrigeration and are thus relatively expensive.

U.S. Pat. Nos. 3,669,856; 3,769,180 and 3,849,263 represent recent developments in the field of coloring aluminum or aluminum alloys. These patents are, in general, directed towards the coloring of anodized aluminum by immersing said article in a bath containing a salt of a particular metal and passing an alternating current between the previously anodized article and a counterelectrode.

Although the process of these patents represent a significant improvement in the field of coloring aluminum, nevertheless, no details are given as to how the previously formed anodic coating is formed on the aluminum and, in fact, at least the implication is present that conventional anodizing techniques are used.

It is also well known in the art of sulfuric acid anodizing of aluminum that two separate and distinct types of an oxide layer can be obtained which are generally referred to in the art as a hard coat or a non-hard coat. The conventional anodizing techniques utilized in the art result in the production of a non-hard coat. There are processes known in the art for the production of hard, dense anodic coatings, but the techniques employed in the art for the subsequent dyeing of these hard, dense coatings have involved the conventional immersion with a suitable dye, as opposed to an electrolytic coloring process. The reason for this might be due to the fact that the techniques for the production of hard anodized coatings result in the production of anodic layers which are significantly colored and can therefore only be dyed to darker, muddied colors by the use of organic or inorganic dyestuffs. The art is also aware that the thicker the anodic layer is formed that the darker the anodic layer will be and, in general, those processes which produced anodic layers had as one of their criticalities the production of a thick layer. These thick layers of anodic film are unsuitable for the novel process of this invention.

As has heretofore been stated, there are processes known in the art for the production of a hard anodized layer and these processes are generally referred to as low temperature (around 32° F.) processes, intermediate temperature (around 45° F.) and room temperature (around 70° F.) processes. The hard coats which are produced via the low and intermediate temperature processes are unsuited for the use of the novel process of this invention for several reasons. In the first place, both processes are expensive and require substantial energy in order to be operative. Secondly, the use of both processes results in the production of a hard anodized coat having a relatively thick non-porous barrier layer which makes it difficult to color electrolytically. Finally, both processes produce an anodized layer which is relatively thick (customarily 1.5 mil or heavier) in order to obtain high heat resistance and is of a darkish, muddied color, thereby rendering it unsuitable for use in a proccess where light, unmuddied colors are desired.

U.S. Pat. No. 3,524,799 is directed towards a room temperature process for anodizing aluminum in order to produce hard, dense anodic coatings and the novel process of the present invention utilizes as one step thereof a modification of the process disclosed by this patentee.

The specification and claims of this patent are directed to the formation of hard, dense anodic coatings on aluminum or aluminum alloys by anodizing the aluminum in an aqueous electrolyte containing a mineral acid, such as sulfuric acid, a polyhydric alcohol of 3 to 6 carbon atoms, an organic carboxylic acid containing at least one reactive group in the alpha-position to the carboxylic acid group, such as lactic acid or glycine, and an alkali salt of a titanic acid complex of a hydroxyaliphatic carboxylic acid containing from 2 to 8 carbon atoms, such as, for example, titanium dilactate ammonium salt.

We have now discovered that the use of such anodizing techniques without the alkali salt of a titanic acid complex provide extremely dense and hard anodic coatings optimally suited to architectural applications and that such anodized layers when colored using the techniques described in U.S. Pat. No. 3,849,263 provide aluminum and aluminum alloy surfaces of very pleasing, architecturally pure colors of exceptional uniformity. Additionally, the use of the combination of these prior art techniques apparently provides exceptional throwing power in the coloring operation. Throwing power is a term of art defining the ability of a coloring bath and process to provide color uniformly to all surfaces of a workpiece undergoing coloring. Thus, a process and bath which demonstrates high throwing power provides uniform color to small creases, cracks, nooks, detents, etc., as well as the larger uniform surfaces of an aluminum or aluminum alloy workpiece being colored. High throwing power also permits the introduction into the coloring bath of a mix of workpieces in terms of their alloy composition and overall physical configuration to obtain uniform color of all such workpieces. In prior art coloring techniques it was often difficult, if not impossible, to obtain uniform coloring of workpieces of different alloys or shapes in a single coloring bath at the same time. Furthermore, as is well recognized by the skilled artisan in the aluminum coloring field, spacing of the various workpieces in the coloring bath was a critical factor in successfully uniformly coloring aluminum extrusions, particularly for architectural purposes. Such spacing restraints often required leaving sufficient distances between the individual pieces being colored that substantial portions of the working volume of a given coloring tank were left empty during a coloring operation resulting in very inefficient use of coloring tank capacity. The exceptional throwing power of the technique of the instant invention permits minimal spacing of the workpieces in the coloring bath and thus optimum usage of the coloring capacity of the coloring tank. This results not only in a more optimum efficiency in terms of use of tank capacity, but reduces substantially the chemical and power requirements of the electrolytic coloring process.

SUMMARY OF THE INVENTION

According to the present invention, a novel process is disclosed for the production of colored coatings on articles of aluminum or aluminum alloys which are particularly adapted to be employed for architectural uses which involves first forming a hard, dense anodic coating on aluminum and aluminum base alloys by anodizing the aluminum in a specific electrolyte comprising sulfuric acid, a polyhydric alcohol of 3 to 6 carbon atoms and an organic carboxylic acid containing at least one reactive group in the alpha position in order to obtain a material having a film thickness of between about 0.6 to about 1.1 mils and thereafter electrolytically coloring said anodized aluminum by passing alternating current between said anodized aluminum and a counter-electrode in an aqueous bath containing acid and a metal salt.

DETAILED DESCRIPTION

In order to obtain the architecturally acceptable and desirable hard anodic coatings of pure clean color as described above, it is absolutely critical that the anodic layer be between about 0.6 and about 1.1 mils in thickness, as opposed to the 1–5 mils set forth at column 3, line 26 of said U.S. Pat. No. 3,524,799.

As already pointed out, the electrolyte used to anodize the aluminum must be of the type described in U.S. Pat. No. 3,524,799 without any alkali salt of titanic acid complex.

Apparently, as described in U.S. Pat. No., 3,524,799, the combination is an anodizing bath of a polyhydric alcohol containing from 3 to 6 carbon atoms, and an organic carboxylic acid containing a reactive group in alpha-position to the carboxylic acid group will react with the hot reaction products formed during anodizing with or adjacent to the surface of the pore base, and thereby suppress the attack or dissolution of the forming oxide film by these products.

The mineral acid component of the electrolyte is sulfuric acid. The anodizing bath concentration of sulfuric acid is generally maintained between about 12% and about 20% by weight, preferably about 15%.

Polyhydric alcohols containing from 3 to 6 carbon atoms which may be employed in the practice of the invention, singly or in admixture, include glycerol, butane-diol 1, 4, pentanediol-1, 5, mannitol and sorbitol. The total amount of polyhydric alcohol employed ranges from about 1% to about 4% by volume of the anodizing electrolyte. The preferred polyhydric alcohol is glycerol at a concentration of between about 1% to about 2%.

The organic carboxylic acids containing a reactive group in alpha-position to the carboxylic acid group include acids in which the reactive group is hydroxy, amino, keto, or carboxyl. Examples of such acids include glycolic (hydroxyacetic), lactic (hydroxypropionic), malic (hydroxysuccinic), oxalic, pyruvic, and aminoacetic acids. Acyclic carboxylic acids such as lactic, malic, and glycolic amino-acetic (glycine) acids are preferred. Glycolic acid is specifically preferred in combination with glycerol. A mixture of two or more of these acids may be employed in combination with the mineral acid and the polyhydric alcohol. The amount of carboxylic acid included in the electrolyte is preferably between about 1% and about 4% by volume of the bath. A preferred concentration when glycolic acid is used in combination with glycerol is between about 1 and 2% by volume.

In order to achieve the results described above, the temperature at which anodizing is carried out must range from about 65° to about 85° F. with room temperature condition, i.e., 68°–75°, F., being preferred.

In order to achieve the exceptionally hard and readily colored anodic coatings, it is also necessary that the current density which is used in the anodizing operation be in the range of from about 24 to about 36 amperes/sq. ft.

The time required to achieve the desired film thickness of between about 0.6 and 1.1 mils will vary with the other parameters of temperature, current density, chemical composition of the bath, etc., but generally anodizing times on the order of from about 16 to about 30 minutes produce acceptable results.

Following the special anodizing treatment, above-described, the aluminum article is thereafter colored electrolytically by passing alternating current between said article and a counterelectrode in an aqueous acidic solution containing a water soluble metal salt. The electrolytic coloring process is extremely well known in the art, and in this connection, is disclosed in the technical and patent literature, including U.S. Pat. No. 3,669,856; 3,849,263 and 3,869,180; the disclosure of which is herein incorporated by reference. The preferred metallic salt is a salt of tin, although salts of nickel, cobalt, copper and silicomolybdic acid and silicotungstic acid can also be employed, individually or in combination. The salts of these metals could be formed by adding the metal to the sulfuric acid in the bath, but, preferably a sulfate salt of the metal is added to the bath for better control of the amount of the metal in solution in the electrolyte.

As is well known in the art, the metallic salts desired to provide the particular color can be utilized at a concentration of from 0.5 to 20% by weight, preferably about 2% by weight based on the electrolyte. The salts modify the pH of the electrolyte to which they are added, and the pH of the complete bath may ordinarily range from about 3.5 to 5. However, when the metallic salt is tin sulfate, the pH may be as low as 1, preferably 1.5. Tin in the preferred metal for the salt because of the high throwing power of the bath and resultant improved color effects at such low pH values.

The alternating current may have a frequency of 10–500 periods per second, preferably 50 periods per second, and a voltage of 2–50 volts and a current density of 0.2–1.0 A/dm$^2$ based on the surface of the aluminum article. The counterelectrode which is employed is preferably made out of the same metal as the metal used in the electrolyte solution. Thus, for example, when utilizing a tin salt in order to impart a bronze color, it is preferred that the counterelectrode be made out of tin. As is known in the art, however, this is not necessary and counterelectrodes made of other materials, such as graphite, stainless steel or titanium can also be used.

A particularly preferred embodiment resides in having present in the electrolyte a certain amount of aluminum. In this connection, the aluminum can be provided by the addition of suitable aluminum compounds, such as aluminum sulfate or a certain part of a previously used electrolytic bath can also be used. The amount of aluminum which is present in the electrolyte can range from 0–12 grams/liter, and more desirably, from 4–8 grams/liter.

As has heretofore been pointed out, the novel process of this invention is applicable to color articles made from aluminum, as well as from aluminum base alloys of all kinds.

The following examples will illustrate the novel process of this invention.

EXAMPLE 1

An aluminum article is anodized for about 24 minutes at 65° F. in an anodizing bath at 1.5 pH and having the following composition:

Sulfuric Acid—15% by weight
Glycolic Acid—1% by volume
Glycerol—1% by volume with a constant current density of about 24 amperes/sq. ft. and a DC voltage rising to about 20 volts. An anodic coating of about 0.8 mils is obtained. The anodized aluminum article is electrically connected with a counterelectrode of tin in an aqueous electrolyte containing 2% by weight stannous sulfate and about 50 ml concentrated sulfuric acid per liter, an alternating current at 5–8 volts is supplied to the electrodes at room temperature for a period ranging from 5–15 minutes and the current density is varied from 0.2 to 0.8 a/dm$^2$. Very attractive bronze tones or black are obtained on the aluminum articles, depending on the duration of the supply of alternating current.

EXAMPLE 2

The process of Example 1 is repeated with the exception that a deep red to black color is obtained, depending on duration, using copper sulfate instead of tin sulfate, a pH of 4.0 and a counterelectrode of graphite.

EXAMPLE 3

The process of Example 2 is repeated with the exception that bronze tones to black are obtained using cobalt sultate as the salt.

EXAMPLE 4

The process of Example 2 is repeated with the exception that bronze tones are obtained using nickel sulfate as the salt and a counterelectrode of nickel.

What is claimed is:

1. In a process for electrolytically coloring articles of aluminum or aluminum alloys, wherein an alternating current is passed between an electrode system comprising a previously anodized aluminum article and a counterelectrode immersed in an acidic bath containing salts of metals capable of coloring the anodized layer, the improvement which comprises, anodizing said aluminum article prior to coloring in an aqueous acid electrolyte comprising from about 12–24 weight percent sulfuric acid, and from 1–4% by volume of a polyhydric alcohol of from 3 to 6 carbon atoms and 1–4% by volume of an organic carboxylic acid containing at least one reactive group in the alpha-position wherein said reactive group is a hydroxy, amino, keto or carboxyl group, and carrying out the anodizing at a temperature of from 65°–85° F. at a current density of from 24–36 amperes/sq. ft., so as to obtain an anodized layer of from about 0.6 to 1.1 mils.

2. The process of claim 1 wherein said anodizing is performed at a temperature of between about 68° and 75° F.

3. The process of claim 1 wherein the organic carboxylic acid is either glycolic acid or lactic acid.

4. The process of claim 1 wherein the polyhydric alcohol is glycerol.

5. The process of claim 1 wherein the metal salt capable of coloring is tin sulfate.

6. The process of claim 1 wherein the metal salt capable of coloring is nickel sulfate.

7. The process of claim 1 wherein the metal salt capable of coloring is copper sulfate.

8. The process of claim 1 wherein the metal salt capable of coloring is cobalt sulfate.

9. The process of claim 1 wherein 4–8 grams/liter of aluminum is present in the coloring bath.

10. In a process for electrolytically coloring articles of aluminum or aluminum alloys, wherein an alternating current is passed between an electrode system comprising a previously anodized aluminum article and a counterelectrode immersed in an acidic bath containing salts of metals capable of coloring the anodized layer, the improvement which comprises, anodizing said aluminum article prior to coloring in an aqueous acid electrolyte comprising from about 12–24 weight percent sulfuric acid, and from 1–2% by volume of glycerol and about 1–2% by volume of glycolic acid carrying out the anodizing at a temperature of from 65°–85° F. at a current density of from 24–36 amperes/sq. ft., so as to obtain an anodized layer of from about 0.6 to 1.1 mils.

11. The process of claim 10 wherein said anodizing is performed at a temperature of between about 68° and 75° F.

12. The process of claim 10 wherein the metal salt capable of coloring is tin sulfate.

13. The process of claim 10 wherein the metal salt capable of coloring is nickel sulfate.

* * * * *